United States Patent [19]

Davidson

[11] 4,365,441

[45] Dec. 28, 1982

[54] SHUTTER SHIELDS (TM) IN COMBINATION WITH AN OUTER AND INNER GLASS AREA MEANS

[76] Inventor: James D. Davidson, P.O. Box 1293, Pontiac, Mich. 48056

[21] Appl. No.: 243,704

[22] Filed: Mar. 16, 1981

Related U.S. Application Data

[63] Continuation of Ser. No. 114,662, Jan. 23, 1980, which is a continuation-in-part of Ser. No. 39,049, May 16, 1979, Pat. No. 4,267,666, which is a continuation-in-part of Ser. No. 912,186, Jun. 5, 1978, abandoned, which is a continuation-in-part of Ser. No. 776,448, Mar. 10, 1977, abandoned.

[51] Int. Cl.[3] ..... E05B 65/04

[52] U.S. Cl. ..... 49/63; 49/362; 49/361

[58] Field of Search ..... 49/63, 362; 52/204; 404/47, 48

[56] References Cited

U.S. PATENT DOCUMENTS 4,204,373 5/1980 Davidson ..... 52/204
4,267,666 5/1981 Davidson ..... 49/63

FOREIGN PATENT DOCUMENTS 467768 8/1950 Canada ..... 49/63

*Primary Examiner*—Kenneth Downey

[57] ABSTRACT

A thermal Shutter Shield (R) device comprised of an outer periphery support frame which supports an outer glass area means and an inner glass area means in a parallel mode, the glass area means are normally called windows, glass sliding doors or glass walls including a glass peripheral frame and a glass panel installed therein, the device is further comprised of a Shutter Shield unit spaced between the glass areas, having one or more sets of horizontal and parallel extending tracks which are vertically spaced a distance at least equal to the height dimension of the glass area units, the tracks extend parallel to the plane of the glass area and beyond at least one side of the side edges of the glass area unit, a laminate insulative Shutter Shield is mounted in the track for movement between positions at the side of the glass area unit and in front thereof to block off the entirety of the glass area, the laminate insulative shield includes a frame movably supported on the track and has an imperforate surface layer and an insulation layer material mounted side by side in the frame, the imperforate surface provides a rigidifying support for the rather fragile insulation material, and a seal structure is provided for effecting a seal around the periphery of the glass panel and between the window unit and the insulative Shutter Shield, the Shutter Shield device including the inner and outer glass areas can be pre-assembled at the factory, installed in the outer periphery device support frame with the thermal shutters installed therebetween, the shutters can be manually traversed by actually reaching between the glass areas and pulling and/or pushing the thermal shutters to an opened or closed mode, or a mechanical manually cranked drive device can be used to traverse the shutters to an opened or closed mode, still further the thermal shutters can be automated by using a motorized method for driving the drive unit which will traverse the shutters to a opened or closed mode, the device being totally pre-assembled at the factory will actually reduce cost at the building site.

8 Claims, 15 Drawing Figures

SHUTTER SHIELDS (TM) IN COMBINATION WITH AN OUTER AND INNER GLASS AREA MEANS

IN THE SPECIFICATIONS

This application for a Patent Letters is a continuing application, co-pending with Ser. No. 114,662, filed 1-23-80 (pending), further continuing from Ser. No. 39,449, U.S. Pat. No. 4,267,666 filed 5-16-1979 (approved), further, continuing from Ser. No. 912,186, filed 6-5-1978 (abandoned), and still further continuing from Ser. No. 776,448 filed 3-10-77 (abandoned), all were filed by Applicant.

CROSS REFERENCES TO RELATED PATENTS

Cross References To Related Patents

| Ser. No. | Filing Date | Status |
|---|---|---|
| 776,448 | 3-10-1977 | (Abandoned) |
| 912,186 | 6-5-1978 | (Abandoned) |
| 4,267,666 | 5-16-1979 | (Approved) |
| 114,662 | 1-23-1980 | (Pending) |
| 4,204,373 | 9-8-1978 | (Issued) |
| 4,267,666 | May 16, 1979 | Issued |

The phrase Shutter Shields (TM) is a registered trademark, registration No. 1,119,269, registered May 29, 1977.

BACKGROUND OF THE INVENTION

1. Field of the Invention

This invention relates to energy conservation used to heat or cool buildings, the buildings having glass areas normally called windows, glass sliding doors and glass walls, these glass areas transfer heat from the building at a very rapid rate, the same applies to cooling the building, heat is transferred into the building, therefore energy used to heat or cool the building is wasted increasing the cost of heating or cooling, this device commonly called Shutter Shields ® is installed in the building wall in place of standard glass areas, the device when closed will thermally insulate the glass areas when not being used, therefore, conserving energy and further reducing the possibility of forcible entry through the glass area means.

2. Description of the Prior Art

The prior art that concerns this application for patent letters is listed in the cross references to related patents. There are many shutter devices or constructions as noted as prior art, but none solve all the problems this invention solves which is an improved thermally insulated Shutter Shield device, when closed will create a double air chamber both sides of the Shutter Shield device which is sandwiched between an outer glass area unit and an inner glass area unit, this device will be a substantial improvement over the prior art, as known.

BRIEF SUMMARY OF THE INVENTION

In general the objects and purposes of the invention are met by providing an outer peripheral frame means, having an outer glass area unit and an inner glass area unit disposed therein, side by side with a thermally insulated Shutter Shield device installed therebetween.

The inner and outer glass area means having glass framing and glass panel means encompassed by a glass area frame which is installed into the outer periphery frame of the device.

The outer periphery frame of the device creates the predetermined rough opening for the inner and outer glass area means and creates a storage pocket on at least one side of the glass area means.

The Shutter Shield device having one or more sets of horizontally and parallel extending tracks vertically spaced a height equal to the vertical height dimension of the glass panel means, the tracks extend parallel to the plane of the glass area means and beyond at least one side edge thereof, creating a shutter storage area.

A laminate insulative Shutter Shield is mounted in the track for movement between positions at the side of the glass area means and in front thereof to block off the entirety of the glass panel means.

The laminate insulative Shutter Shield includes a frame movably supported on the track and has an imperforate surface layer and an insulation layer mounted side by side in the frame.

A seal is provided for effecting a seal around the periphery of the outer glass area unit when the shutters are in a closed mode defining a first sealed chamber between the outer glass area unit and the outer shutter surface and a second sealed chamber therebetween the inner shutter inner surface and the inner glass area means, effecting a double sealed chamber.

Accordingly it is the improved object of this invention to provide a thermally insulated Shutter Shield device for use in combination with an outer glass area means and an inner glass area means, commonly called a window, glass sliding door or a glass wall. The thermally insulated Shutter Shield device is installed therebetween said glass area units, the Shutter Shield device has the capability of minimizing heat transfer therethrough while simultaneously offering a rather substantial barrier against unauthorized entry.

It is a further improved object of this invention to provide a shutter unit for use in combination with an outer and inner glass area means, as aforesaid, wherein the insulation material is utilized as the means by which the heat transfer therethrough is minimized.

It is a further improved object of this invention to provide a shutter unit, as aforesaid, wherein the insulation material, which has a rather fragile characteristic, is rigidified by a barrier surface, which the barrier surface prevents unauthorized entry.

It is a further improved object of this invention to provide a Shutter Shield device, inner and outer glass area combination, as aforesaid, which is capable of preassembly at the factory for installation into the building during construction.

It is a further improved object of this invention to provide a Shutter Shield, inner and outer glass area means combination, as aforesaid, wherein the insulative Shutter Shield member is incapable of removal from the Shutter Shield track means which is installed in the outer peripheral Shutter Shield device frame, therefore, while the Shutter Shield is in a blocking relation with respect to the glass area means.

It is a further improved object of this invention to provide a peripheral frame means which will define the rough openings for the outer and inner glass area means.

It is a further improved object of this invention to provide an outer periphery frame means which will create a shutter storage area at least one side edge of the glass area means.

It is a further object of this invention to provide a sealed chamber between the inner and outer glass area means when the thermal insulated Shutter Shields are in an opened mode, creating a sealed chamber width to substantially improve the R-factor of the device.

It is a further object of this invention to provide a glass area means with a sealed chamber therebetween, when the shutters are in a closed mode the sealed chamber is divided by the closed shutters providing an inner and outer sealed chamber, defined as the air space between the shutter surfaces and the glass panel means.

It is a further improved object of this invention to provide a openable glass panel means to provide a path for fresh air therethrough the glass panel means and having a protective screen to cover the air passage at least on the outside opening.

It is a further improved object of this invention to provide a means to open at least one glass panel to provide a manual hand means for closing or opening the thermal shutters.

It is a further improved object of this invention to provide an inner glass area unit with lift out glass panels to provide room to install or remove the thermal shutters for cleaning or maintenance.

It is a further improved object of this invention to provide a split Shutter Shield track to provide an easy method for removal of the track and the drive unit for maintenance.

It is a further improved object of this invention to provide an outer peripheral frame for the device which is completely encompassed by a compressed thermal insulation tape device, when the frame is installed in the building wall, the compressed thermal insulation is capable of being rendered inoperative allowing the thermal insulation to expand filling the crack between the device outer periphery frame means and the building wall structural framing, therefore, reducing heat transfer and infiltration through the crack.

It is a further improved object of this invention to provide a manually crank operated drive unit to close or open the thermal Shutter Shields.

It is a further improved object of this invention to provide a motorized method of automation to traverse the shutters to an opened or closed mode, the motorized method can be manually controlled, or automatically controlled by a photo-cell switch, heat control switch or a combination thereof.

It is a further improved object of this invention to provide a thermal Shutter Shield device in combination with an outer and inner glass area means and that the shutters in a closed mode will have an appealing appearance and are of durable construction.

Further objects and purposes of this invention will be apparent to persons acquainted with apparatus of this general type upon reading the specifications and inspecting the accompanying drawings.

BRIEF DESCRIPTION OF THE DRAWINGS

FIG. 7 shows how the manual drive unit is installed in the lower track means, showing the gear box and the threaded shafts which turn traversing the drive block pulling the shutters to an opened or closed mode.

DETAILED DESCRIPTION OF THE INVENTION

Reference is now made in greater detail to the drawings which are illustrative only, and wherein like elements are designated by the same numerals.

Figures 1, 2, 3:
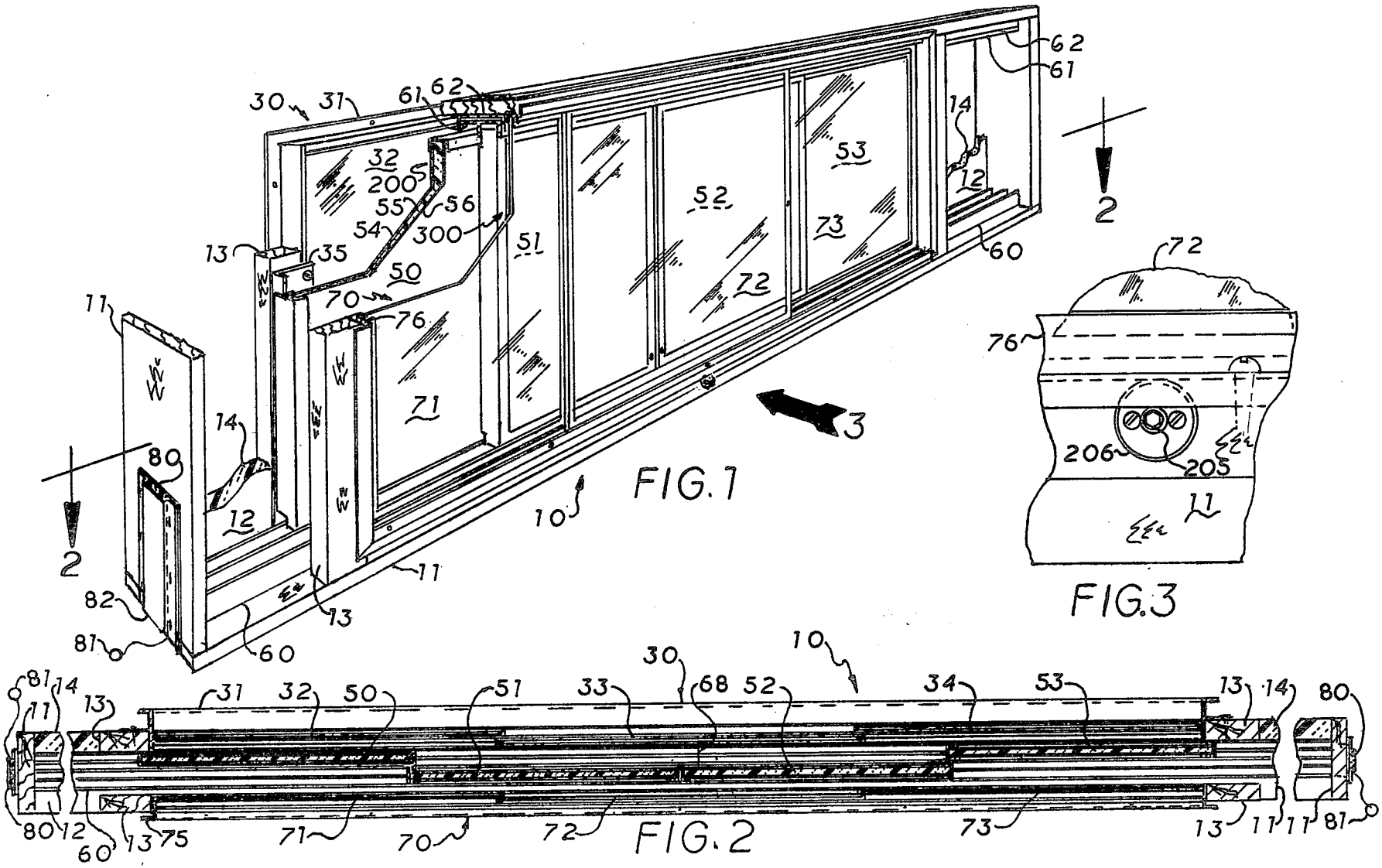
FIG. 1, is a pictoral view of the invention showing a cut-a-way of the device frame disclosing the outer glass area unit, the thermal shutters and the inner glass area unit, further shown is the shutter pockets and the shutter track.
FIG. 2, is a section taken on line 2—2 in FIG. 1, showing the outer glass area, the four thermal shutters and the inner glass area unit disposed in the device frame which is encompassed by the enveloped, compressed thermal insulation tape device.
FIG. 3, is taken in the direction of arrow 3 from FIG. 1, and is a blow up showing the drive shaft for the manual shutter drive unit.
Figure 4:
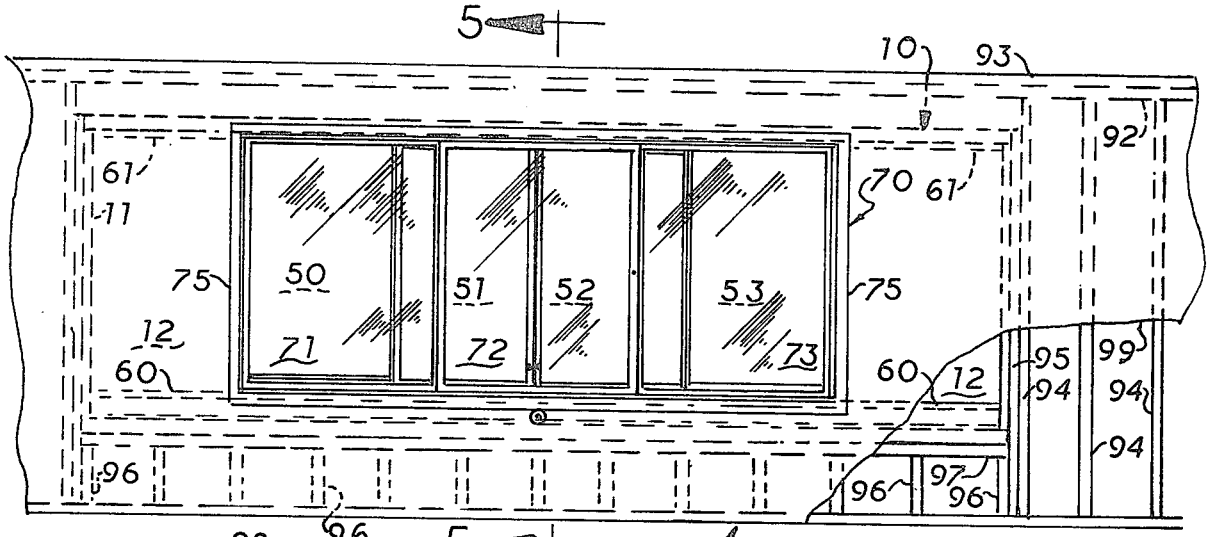
FIG. 4, is a typical building wall, with FIG. 1, installed therein showing the method of installation.
Figure 5:
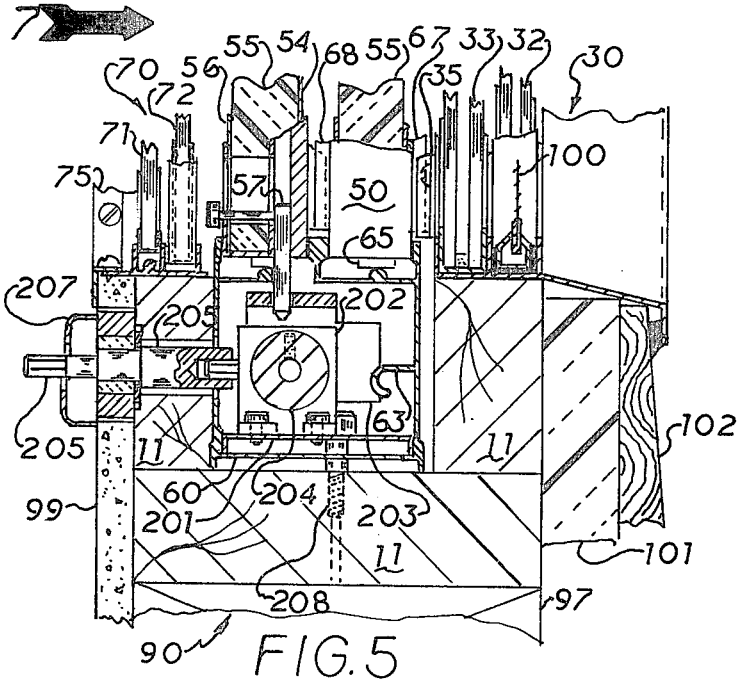
FIG. 5, is a typical section taken on line 5—5, FIG. 4, showing how the device is installed and covered.
Figure 7:
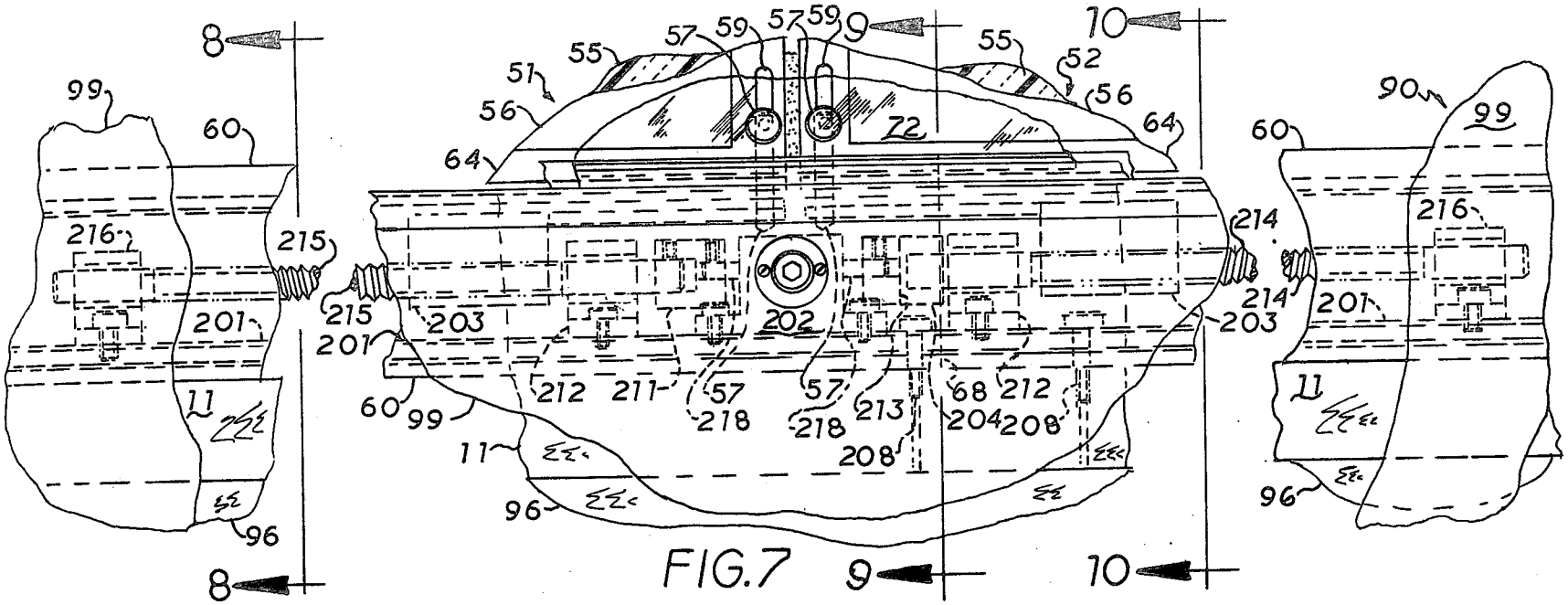
FIG. 7, is a view taken in the direction of arrow 7, FIG. 5.

The invention as disclosed in FIG. 1 which is a pictoral view showing the cut-a-way frame means of device 10 which has an outer periphery support frame 11 that defines the rough openings for the glass area means 30 and 70, inner and outer, the frame 11 also provides the storage pockets 12 for the thermal Shutter Shields 50 through 53, the storage pockets 12 are thermally insulated with insulation material 14, the frame 11 material can be wood, plastic, metal or a combination thereof, the frame 11 supports the inner glass area means 70, supports the outer glass area means 30, and maintains the upper track 61 and the lower track 60 in a parallel relationship, therebetween, vertically spaced at least equal to the vertical height dimension of the glass area means 30 and 70, the support frame 11 provides vertical nailers 13 to support the side edges of the glass area means 30 and 70, plus, provides a metal fastener support for the drywall 99 on the inside wall and a metal fastener support for the outside wall sheathing 101 and the outside siding 102 which are shown in FIGS. 4 and 5, the frame 11 which is the outer periphery support for the device 10 which is of precision construction as now used in the window industry, the frame 11 can be designed to suit any possible Shutter Shield glass area combination, such as windows, glass sliding doors or glass walls, frame 11 can be modified to suit small windows using one thermal Shutter Shield stored at the side of the window, or a plurality of Shutter Shields stored at one side of the glass area means or stored both sides as shown in the drawings, the drawings depict the worst condition which would be a large picture window 30 which would require at least four thermal Shutter Shields 50 through 53 to block off and thermally seal the entire glass area, the frame 11 as shown in FIGS. 4 and 5 can be installed in a standard six inch wall or be used in a standard four inch wall by furring out the inside wall at the frame 11 area, this is not shown in the drawings.

Device 10 with the outer periphery support frame 11 supports the outer glass area means 30, which is a window in this instance, having three glass panels 32–34 as shown in FIG. 2, the glass is maintained in the glass area frame 31, the glass panels 32 and 34 are non-moving and glass panel 33 is sliding to allow means for fresh air to enter therethrough, the opening is screened 100 as shown in FIG. 5, glass area 30 can be single glazed or have a plurality of glazing means 32 supported in a wood, metal, plastic or a combination thereof framing construction, further shown in FIG. 1 is the inner glass area means 70 which is a single glazed window construction, in this instance having three glass panel units 71 through 73, panels 71 and 73 are non-sliding while panel 72 is sliding to allow fresh air to enter therethrough, the inside glass area means 70 has three glass panel means 71, 72 and 73 which are removable to allow cleaning and/or maintenance of the thermal shutters 50–53 or allow shutter removal so the upper track 61 and lower track 60 can be removed for maintenance purposes.

Figure 13:
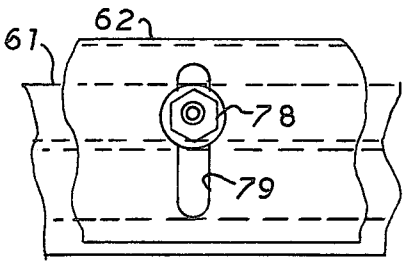
FIG. 13, is taken in direction of arrow 13, showing the slot for raising and lowering the upper track.
Figure 12:
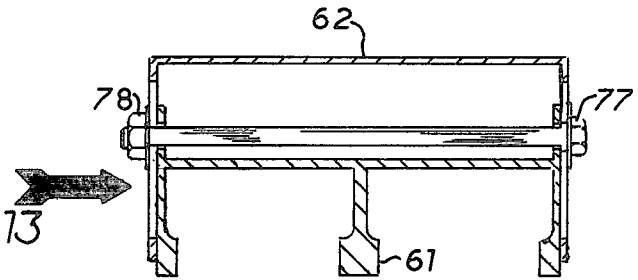
FIG. 12, is a typical section showing how the upper track is installed in a "U" shape adjusting bracket allowing the track to be adjusted up and down in relation to the shutters.

The split lower track 60 can be made from wood, metal, or plastic or a combination thereof, and is installed parallely therebetween the glass area means 30 and 70 and attached to the lower frame 11 with metal fasteners 208, the lower track 60 can also house a drive means as shown in FIGS. 5,6,7,8,9,10,14 and 15, upper split track 61, FIGS. 1,5, and 12 is maintained in a leveling bracket 62, with track leveling fastening means 77 and 78, see FIGS. 12 and 13, both can be made from wood, metal, plastic, or a combination thereof, the leveling bracket 62 is installed to the upper frame 11 parallely spaced between the glass area means 30 and 70 with metal fasteners 209.

The thermally insulated Shutter Shields 50 through 53 are of laminate construction as shown in FIGS. 1,2,5,7,9,10, having an imperforate surface layer 54 side by side with a decorative layer 56 and a thermal insulation layer 55 sandwiched therebetween and supported in a frame means 64, the thermal insulation 55 reduces heat transfer either direction through the device 10 glass area means 30 and 70 including the window or glass area frames 31 and 76, the thermal Shutter Shields 50 through 53 are installed in the upper and lower track means 60 and 61 and are supported on a frictionless slide block 65, in this instance, for movement from the storage pockets 12 to an area blocking off the entirety of the glass area means 30 and 70, the shutters in a closed mode create a double sealed chamber designated as 200 on the outside and 300 on the inside, a periphery seal means is provided to maintain the sealed chambers 200 and 300 therebetween.

The shutters are also provided with overlapping come-a-long flanges 67 and 68, as shown in FIG. 5, that also seals between the shutters and provides a means for pulling or pushing the shutters.

Figure 6:
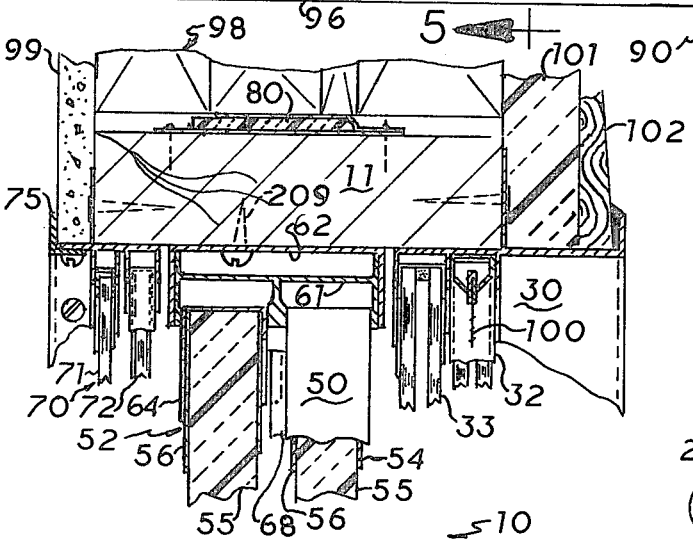
FIG. 6, is a blowup of FIG. 5, showing the manual drive crank means and the crank cover.
Figure 6:
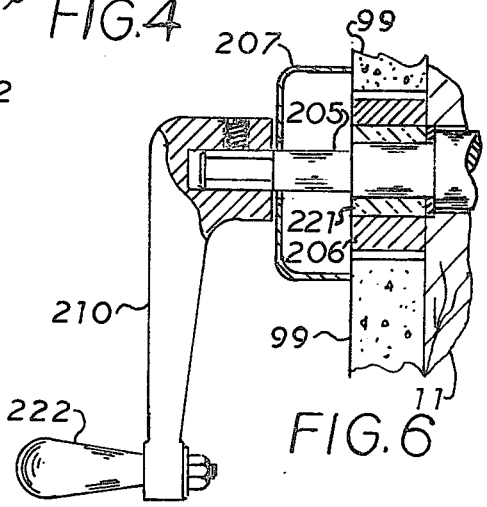

Glass panel means 72 is movable, sliding in this instance, which allows the shutters to be manually traversed to a opened or closed mode, further shown in FIGS. 5,6,7,8,9,10, and 11 is a manually operated drive means comprising a mounting plate 201 with a 90 degree gear box 202 attached thereto which is connected to a drive shaft extension 205 which can be manually turned with a crank 210 as shown in FIG. 5 or 6, the manually operated drive unit mounted on mounting plate 201 is clearly shown in FIGS. 5 through 11, FIG. 7 is a blown up view of the lower track in the direction of arrow 7, FIG. 5, which shows the extension drive shaft 205 which is attached to the gear boxes 202 input shaft 217, the gear box 202 is of standard construction, well known in the art and no descriptive detail is necessary, the gear box 202 output shafts 218 are rotatably turned, coupled to the right hand shutter traversing shaft 214 which has left hand treads, the coupling 204 ties the gear box output shaft 218 with the traversing shaft 214 which is supported by two bearing blocks 212 and 216, the bearing blocks are of standard construction well known in the art, no further description is required, the opposite traversing shaft 215 is also supported by two bearing blocks 212 and 216 and is tied to the gear box 202 output shaft 218 with a coupling 211 which is standard within the art, the traversing shaft 215 has right hand threads, each traversing shaft 214 and 215 have a traversing drive block 203 which will traverse in or out from the device 10 vertical center line to open or close the thermal shutters 50–53.

The drive blocks 203 have a receiving hole for the shutter drive pins 57 which pushes or pulls the thermal shutters to an opened or closed mode.

Figure 11:
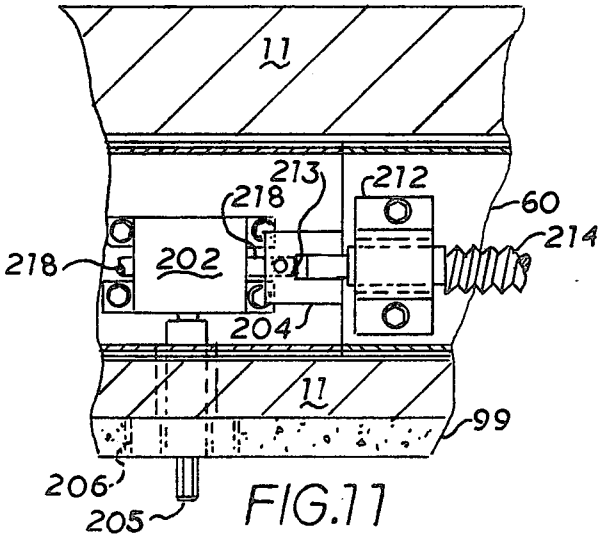
FIG. 11, is a section taken line 11—11 FIG. 1, showing a plan view of the gear box and the "U" shaped drive coupling.

The drive pins 57 are easily disengaged from the traversing drive blocks 203 allowing the shutters 51 and 52 to be manually pushed aside to provide a passageway to the outside of the building in case of an emergency, such as a fire, or easily disengaged so the shutters can be pushed aside or removed from the track 60 and 61 for maintenance purposes, for maintenance purposes the track 60 and 61 is split at line 68 just to the right of the gear box 202, the coupling 204 has a "U" shaped slot 213 which engages the flat sides of the shaft 214, shaft 214 can be easily disengaged from the coupling 204 allowing the split track to be lifted up and out of the device 11, this is clearly shown in FIG. 11 which is a cut-a-way section.

Figure 9:
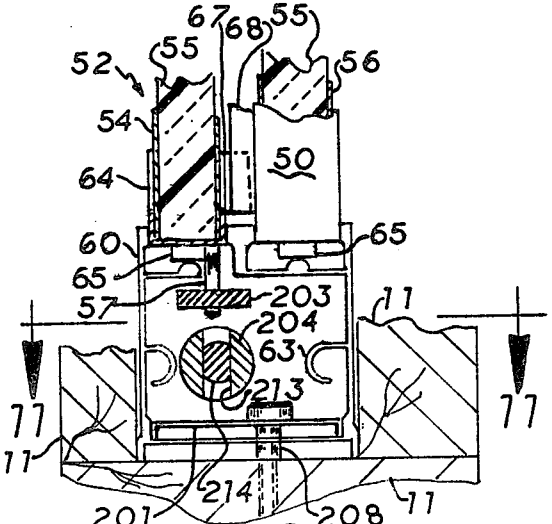
FIG. 9, is a section taken in line 9—9 FIG. 7, at the split in the track disclosing a drive coupling with a "U" shaped slot to hold the drive shaft but the shaft can be lifted out of the drive coupling, allowing the drive unit to be lifted out of the device for maintenance purposes.
Figure 8:
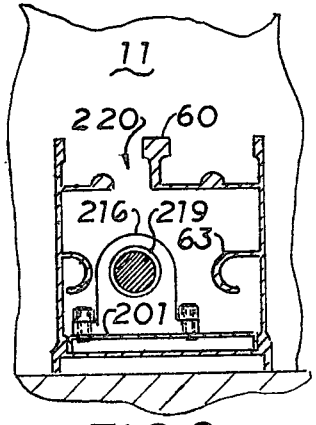
FIG. 8, is a section taken on line 8—8 FIG. 7, showing the track construction and how the drive unit shaft is maintained in a bearing block.

FIG. 8 shows how the bearing block 216 with bearing 219 is mounted to the mounting plate 201, further shown is the slot 220 which the shutter drive pins 57 pass through to engage the traversing drive blocks 203, this is more clearly defined in FIG. 5 or FIG. 9, FIG. 9 shows how the drive pins 57 engage the traversing block 203, further shown is the track 60 and the traversing block ways 63 and the hold down fastening means 208 which fastens the track means 60 to the frame 11.

Figure 10:
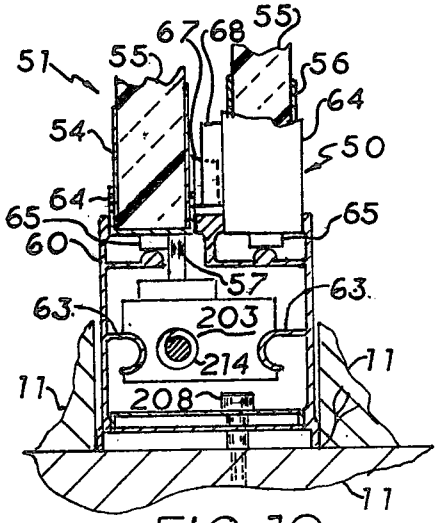
FIG. 10, is a section taken on line 10—10 FIG. 7, showing how the drive block traverses on the thread shaft and held from turning on the ways.

To further disclose the shutter manually operated drive unit, FIG. 10 shows the traversing drive block 203 which is driven by the rotatable drive shaft 214 which is manually driven, the block 203 is traversed on the ways 63 and is engaged with shutter pin 57 which pulls or pushes the shutter to a opened or closed mode.

Figure 14:
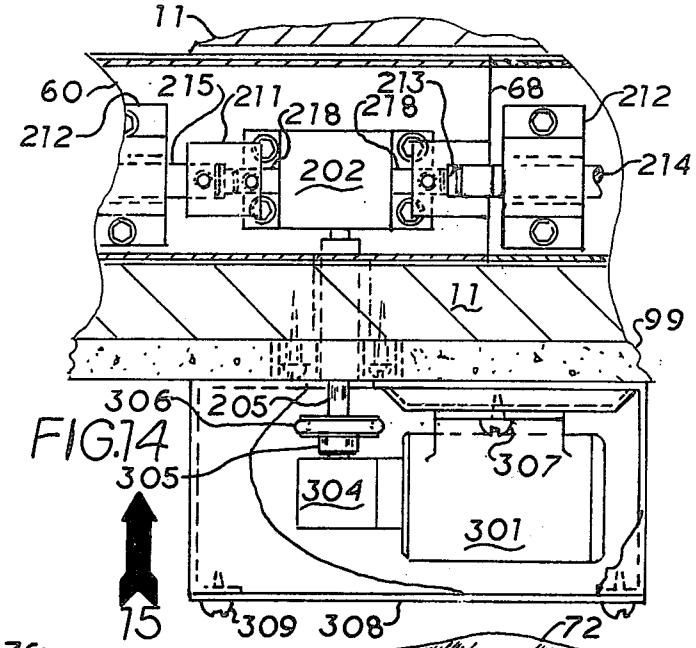
FIG. 14, is the same as FIG. 11, except a motorized means has been added to automate the drive unit for traversing the shutters.

The device 10, shutters 50 through 53 can be manually operated by opening the movable inner glass panel means 72 and physically pushing or pulling the shutters to a opened or closed mode, or with the manual drive unit they can be manually operated by turning the hand crank 210 which is attached to the extension drive shaft 205 which is supported by a bearing block 206 and bearing 221 which is demonstrated in FIG. 6 or FIG. 5, the extension shaft 205 is attached to the input shaft 217 of gear box 202, the third way demonstrated in the drawings is FIG. 14 which is a plan view section, the same as section 11 which shows the gear box 202 and the traversing shafts 214 and 215, also showing gear box 202 and input shaft 217 which is connected through the extension shaft 205 having a drive pulley 305, further having a motorized automation means 301 with an attached gear motor 304 with a drive pulley 310, the drive pulleys are engaged by the timing belt 306, the motorized means 301 can be manually controlled and energized by a manual switch, a photo electric cell switch, heat switch or a combination thereof, in large buildings where many glass area shutter units must be controlled they could be programmed by a computer, using standard electrical circuitry and computer programing.

The improved art in this application is the inner glass area means, the drive means which opens or closes the shutters, and the shutters being in a closed mode which create a double sealed chamber, the double glass areas provide a wide enough air chamber to actually improve the R-factor when the shutters are in a opened mode, this new art will substantially improve the overall art as described by the cross references to related patents.

This improved invention, device 10, which is easily pre-assembled at the factory for installation in a standard wall as depicted in FIG. 4, FIG. 4 shows a standard six inch wall 90 with the drywall 99 cut-a-way to show the sole plate 91, the double top plates 92 and 93 spaced apart by the vertical studs 94, further shown is the header 98 which is supported by the header support studs 95, the device 10 wall rough opening is defined by the header 98, the rough sill 97 and the header studs 95, the shutter device 10 with frame means 11 having a compressed thermal insulation tape means 80 attached to and completely encompassing the frame 11, which is installed in the wall rough opening, leveled, and the compressed thermal insulation tape means 80 which is compressed and maintained in a enveloping means 82 is now rendered inoperative by pulling the rip-cord 81 releasing the compressed thermal insulation allowing it to expand filling the crack found between frame 11 and the wall structural framing components which are the header 98, the header support studs 95 and the rough sill 97, the thermally insulated crack will reduce heat transfer or infiltration either direction through said crack.

Figure 15:
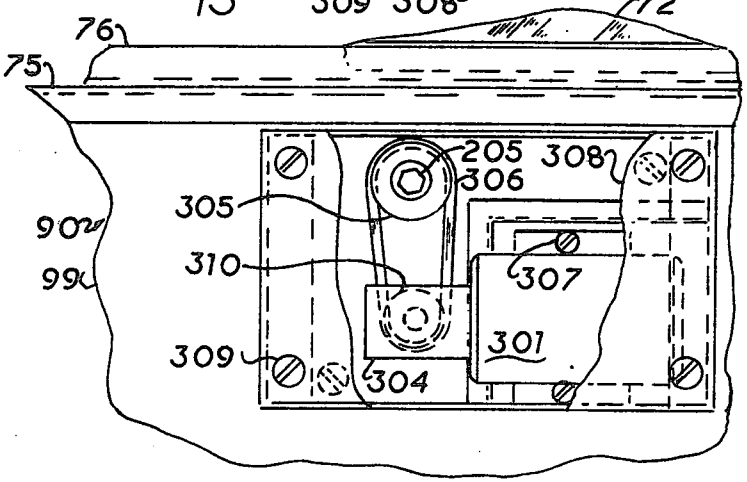
FIG. 15, is a view taken in the direction of arrow 15, FIG. 14, showing the motorized means and how it drives the drive unit.

The device 10 having a precision built frame 11 which supports the inner glass area means 70 and the outer glass area means 30 in a side-by-side parallel mode, with the Shutter Shield device installed therebetween, the device 10 will standardize the method of installing thermal Shutter Shields devices as aforesaid, into a building wall, providing the factory built pockets 12 for the shutters 50 through 53, providing the inside trim means 75 to cover the rough edges of the drywall 99, provides a manual means of opening a glass panel means 72 and actually pulling the shutters manually to a closed position, or the manual crank means can be installed as shown in the drawings FIGS. 1,3,5, and 6, or the automated means 301 could be installed as shown in FIGS. 14 and 15, this invention solves many problems and substantially improves the prior art as known.

Other objects and advantages of the invention will become readily apparent to persons versed in the art of thermal Shutter Shields as described in the specifications and drawings.

I claim:

1. An improved thermally insulated shutter shield device having an outer periphery support frame means in combination with a glass area unit commonly called a window, glass sliding door or glass wall, mounted in a building structure having upright walls, said glass area unit including a glass area frame and glass panel means mounted in said glass area frame, said shutter shield device having first and second parallel track means spaced inwardly of said window unit and having a spacing therebetween at least equal to one height dimension and being parallel to said glass area means;

laminate insulative shield means mounted in said track means for movement between positions adjacent to the side of said glass area unit and in front thereof, to block off the entirety of said glass area means, low friction means for supporting said laminate insulative shield means for movement on said track means, said laminate insulative shield means including a frame movably supported on said track means and having a rigidifying means and an insulation material layer mounted in said frame, said insulative material layer having little resistance against breakage when forces are applied in directions perpendicular to the plane thereof, said rigidifying means providing a rigidification of said insulative material against the effects caused by forces applied from the outside in directions perpendicular to the plane thereof; and seal means for effecting a seal around the periphery of said glass panel means and between said glass area unit frame means and said insulative shutter shield means, thereby defining a sealed chamber, wherein the improvement comprises:

a second glass area means including a glass area frame means having at least one glass panel means movably mounted in said glass area frame means, said glass panel frame means is mounted inwardly of said thermally insulated shutter shield device, fastened to said shutter shield outer periphery support frame means in a parallel mode to said shutter shield device means, said inner movable glass panel means provides access to manually hand close or open said thermally insulated shutter shields; and a second seal means for effecting a seal around the periphery of said second movable glass panel means and between said second glass area unit frame means and said insulative shutter shield device means thereby defining a second sealed chamber, thusly improving the overall R-factor of said combination reducing heat transfer either direction through said first and second glass area means reducing heating and air conditioning cost of said building, whereby energy is conserved.

2. An improved thermally insulated shutter shield device as recited in claim 1, wherein said laminated insulation layer rigidifying means is an imperforate surface layer.

3. An improved thermally insulated shutter shield device as recited in claim 1, wherein said laminated insulation layer rigidifying means is a metallic surface layer.

BEST AVAILABLE COPY

4. An improved thermally insulated shutter shield device as recited in claim 1, comprised of an upper and lower track means; wherein the improvement comprises:

means for splitting said upper and lower track means providing a method for easy installation or removal of said track means.

5. An improved thermally insulated shutter shield device as recited in claim 1, comprised of a lower split track means housing a manually crank operated shutter drive unit to traverse said thermally insulated shutter shield to an opened or closed mode, wherein the improvement comprises:

first and second threaded drive shaft means having opposing right and left hand thread means installed thereon and maintained in a mode of rotatable precision alignment, spaced apart and connected equadistant from said devices vertical center line by an angular energy transfer means having a manually operated crank means installed thereon;

shutter drive block means having a shutter shield drive pin receiving hole therein is threadedly disposed on each first and second rotatable drive shaft means, and spaced apart equadistantly from said devices vertical center line in a non-rotatable mode;

at least one thermally insulated shutter shield means having a shutter drive pin installed therein, is installed in said track means on both sides of said devices center line;

said shutter drive pins are vertically aligned extending downward to engage said shutter drive slide block means shutter drive pin receiving hole, whereby said shutter shield can be manually hand cranked and traversed to an opened or closed mode.

6. An improved thermally insulated shutter shield device as recited in claim 5, having a drive unit for traversing said shutter shield to an opened or closed mode and housed in the lower split track means of said device, wherein the improvement comprises:

means for motorizing said devices shutter traversing drive unit.

7. An improved thermal insulation shutter shield device as recited in claim 1, having at least one movable openable glass panel means installed in the first and second glass area units, providing an opened air passageway therethrough, having means for screening at least the outside opened air passageway, created when said movable glass panel means are in an opened mode.

8. An improved thermal insulation shutter shield device as recited in claim 4, having first and second glass area means comprised of at least one movable glass panel means on at least the second glass area means, said movable glass panel means is mounted inwardly from said shutter shield device means, wherein the improvement comprises:

means for removing said movable glass panel means from said device to provide access to said devices split track means and said thermal shutters for maintenance purposes.

* * * * *